US012667768B2

(12) United States Patent
Zhou

(10) Patent No.: US 12,667,768 B2
(45) Date of Patent: Jun. 30, 2026

(54) PORTABLE BALL NET STAND DEVICE FOR EASY DISASSEMBLY AND ASSEMBLY

(71) Applicant: Xingyu Zhou, Ji'an (CN)

(72) Inventor: Xingyu Zhou, Ji'an (CN)

( * ) Notice: Subject to any disclaimer, the term of this patent is extended or adjusted under 35 U.S.C. 154(b) by 419 days.

(21) Appl. No.: 18/490,153

(22) Filed: Oct. 19, 2023

(65) Prior Publication Data

US 2025/0099833 A1 Mar. 27, 2025

(30) Foreign Application Priority Data

Sep. 23, 2023 (CN) ..... 202322592055.3

(51) Int. Cl.
*A63B 71/02* (2006.01)
*A63B 71/00* (2006.01)
*E04H 12/22* (2006.01)

(52) U.S. Cl.
CPC ..... *A63B 71/023* (2013.01); *A63B 71/0045* (2013.01); *E04H 12/2246* (2013.01); *A63B 2071/025* (2013.01); *A63B 2071/026* (2013.01)

(58) Field of Classification Search
CPC ..... A63B 71/0045; A63B 71/023; A63B 2071/025; A63B 2071/026; E04H 12/2246
See application file for complete search history.

(56) References Cited

U.S. PATENT DOCUMENTS 906,848 A * 12/1908 Atwell ..... A63B 61/02 473/493
7,001,315 B1 * 2/2006 Diodati ..... A63B 21/0552 482/121
2005/0255946 A1 * 11/2005 Liu ..... A63B 63/083 473/481
2016/0287963 A1 * 10/2016 Mosher ..... A63B 69/0002

FOREIGN PATENT DOCUMENTS

AU 2008100899 * 10/2008
AU 2008100899 A4 * 10/2008 ..... E01F 9/692

* cited by examiner

*Primary Examiner* — Brian O Peters
(74) *Attorney, Agent, or Firm* — JEEN IP LAW, LLC

(57) ABSTRACT

The present application discloses a portable ball net stand device including two base bodies, a water bag, and a pin; the two base bodies are rotatably connected through the pin, and after separation, they form two separate ball net bases; the base body has an internal space, and there is an upright rod hole and a rotation shaft on the base body; the internal space is used to accommodate the water bag and sports equipment. Because it is relatively light, it is easy to carry when going out for play or venue transfer. By injecting water into the water bag, a weight of the ball net stand device can be increased to enhance a stability of the ball net stand device and prevent problems such as displacement caused by an external force impact. A roller and a handle have been designed to facilitate a user to drag and move.

14 Claims, 12 Drawing Sheets

PORTABLE BALL NET STAND DEVICE FOR EASY DISASSEMBLY AND ASSEMBLY

CROSS-REFERENCE TO RELATED APPLICATIONS

This application claims priority to Chinese Patent Application No. 202322592055.3, filed on Sep. 23, 2023, which is hereby incorporated by reference in its entirety.

TECHNICAL FIELD

The present application relates to the field sport equipment, and in particular, to a portable ball net stand device for easy disassembly and assembly.

BACKGROUND

The ball net stand on the market is generally composed of an upright rod and a hollow base surrounded by an iron sheet, the upright rod is vertically set on the hollow base. However, the base is inconvenient to move when in use. The base is surrounded by a hollow iron sheet, which has problems such as lightweight, low structural strength, and susceptibility to displacement caused by external forces. If designed as solid and heavy, it cannot be moved, which also brings some inconvenience to use. In addition, it is not convenient to carry when traveling and playing.

SUMMARY

In order to make up for the above shortcomings, the present application provides a portable ball net stand up device that is convenient for disassembly and assembly, aiming to improve the problems mentioned in the background technology.

Embodiments of the present application provide a portable ball net stand device that is convenient for disassembly and assembly. The ball net stand device includes two base bodies, a water bag, and a pin; the two base bodies are rotatably connected through the pin; the base body has an internal space, and there is an upright rod hole and a rotation shaft on the base body; the internal space is used to accommodate the water bag.

In an embodiment of the present application, the base body is provided with a roller and a handle.

In an embodiment of the present application, the base body is provided with two rollers.

In an embodiment of the present application, the roller and the handle are both positioned at a bottom side of the base body; and the handle is positioned at another side of the roller.

In an embodiment of the present application, the roller and the upright rod hole are positioned at the same side.

In an embodiment of the present application, the water bag includes an inlet and outlet.

In an embodiment of the present application, the water bag includes two inlets and two outlets.

In an embodiment of the present application, the inlet and the outlet are positioned above the water bag and positioned at the same centerline.

In an embodiment of the present application, the internal space is used to accommodate sports equipment.

In an embodiment of the present application, the internal space is provided with a clamp strip, which is used to fix the sports equipment.

In an embodiment of the present application, the internal space is provided with a step, which is used to separate the internal space and support the water bag.

In an embodiment of the present application, the upright rod hole is provided with a fix circular table; the fix circular table is used to assist in fixing a ball net rod.

Compared with the prior art, the beneficial effect of the present application is: the present application provides a portable ball net stand device for easy disassembly and assembly, the ball net stand device includes two base bodies, a water bag, and a pin; the two base bodies are rotatably connected through the pin; the base body has an internal space, and there is an upright rod hole and a rotation shaft on the base body; the internal space is used to accommodate the water bag and sports equipment. By injecting water into the water bag, a weight of the ball net stand device can be increased to enhance a stability of the ball net stand device. Considering a convenience of movement, a roller and a handle have been specially designed to facilitate a user to drag and move.

BRIEF DESCRIPTION OF DRAWINGS

In order to provide a clearer explanation of the technical solution of the present application, a brief introduction will be given to the drawings required for the embodiments. It should be understood that the following drawings only illustrate some embodiments of the present application, and therefore should not be regarded as limiting the scope. For ordinary technical personnel in the art, other relevant drawings can also be obtained based on these drawings without creative work.

DESCRIPTION OF EMBODIMENTS

Figure 1:
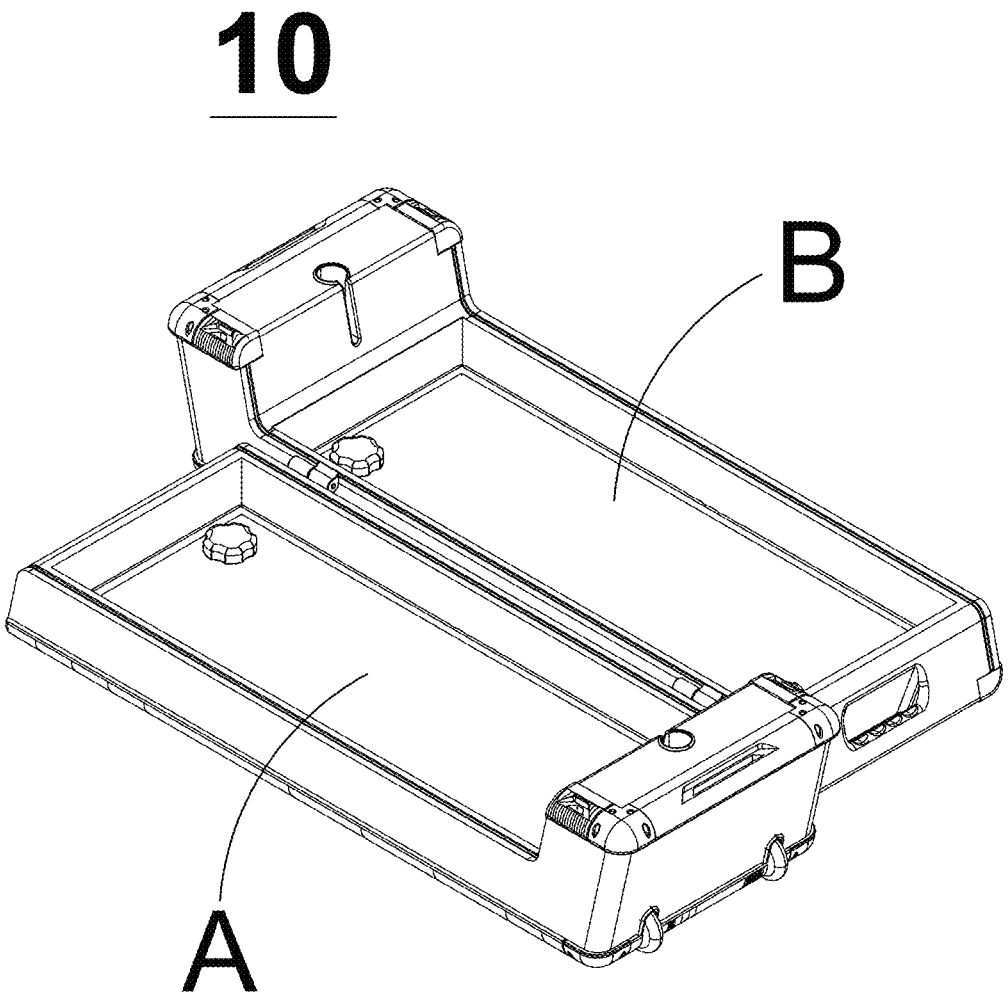
FIG. 1 is a structural schematic diagram of a deployment of a ball net stand device provided in Embodiment 1 of the present application.
Figure 2:
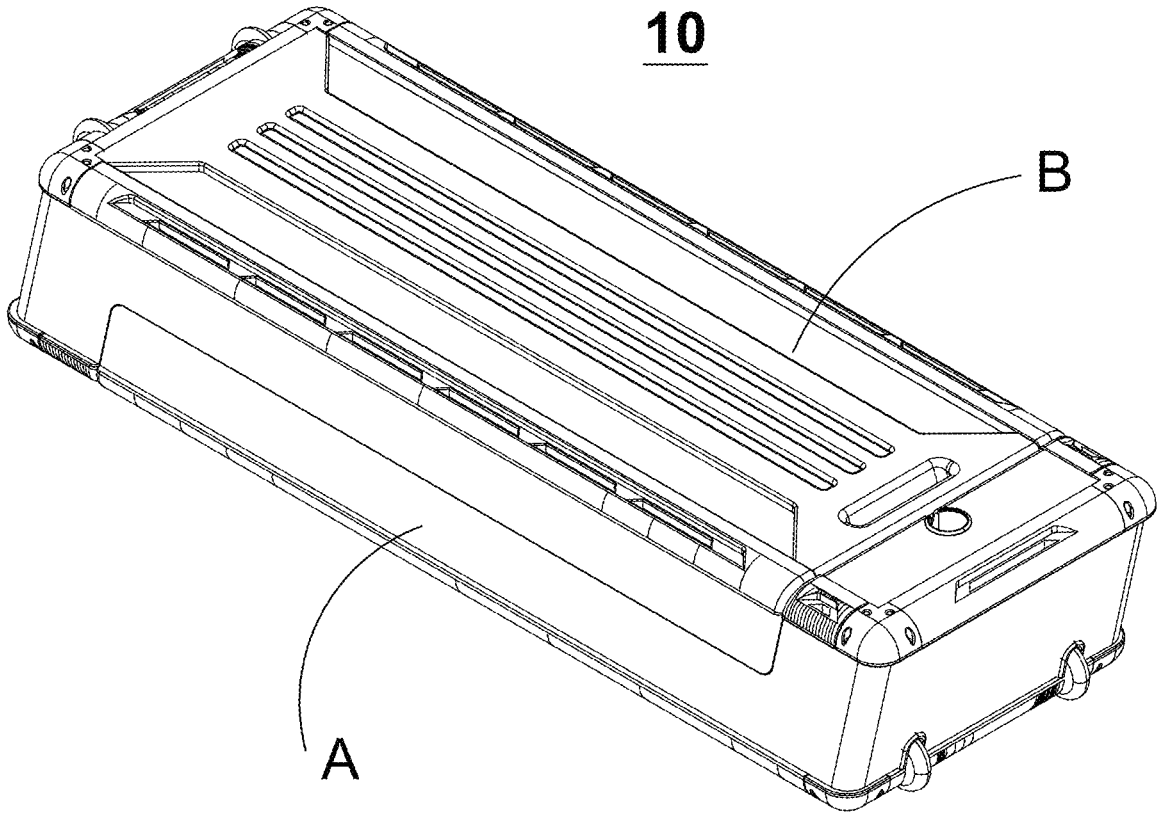
FIG. 2 is a schematic diagram of a folded structure of the ball net stand device provided in Embodiment 1 of the present application.
Figure 3:
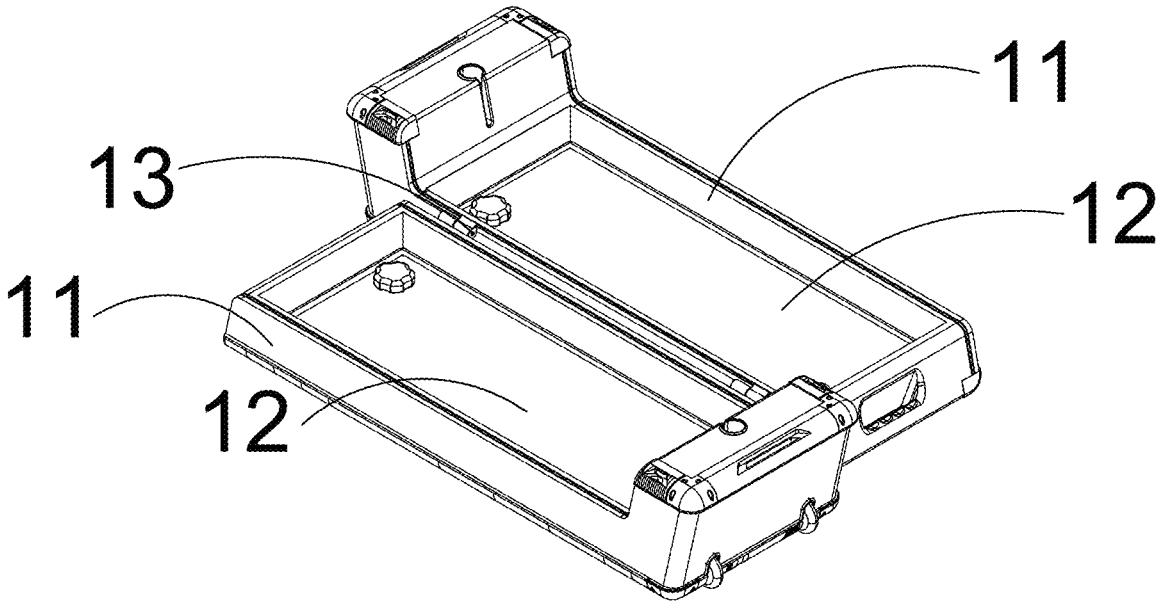
FIG. 3 is a schematic diagram of a composition of the ball net stand device provided in Embodiment 1 of the present application.
Figure 4:
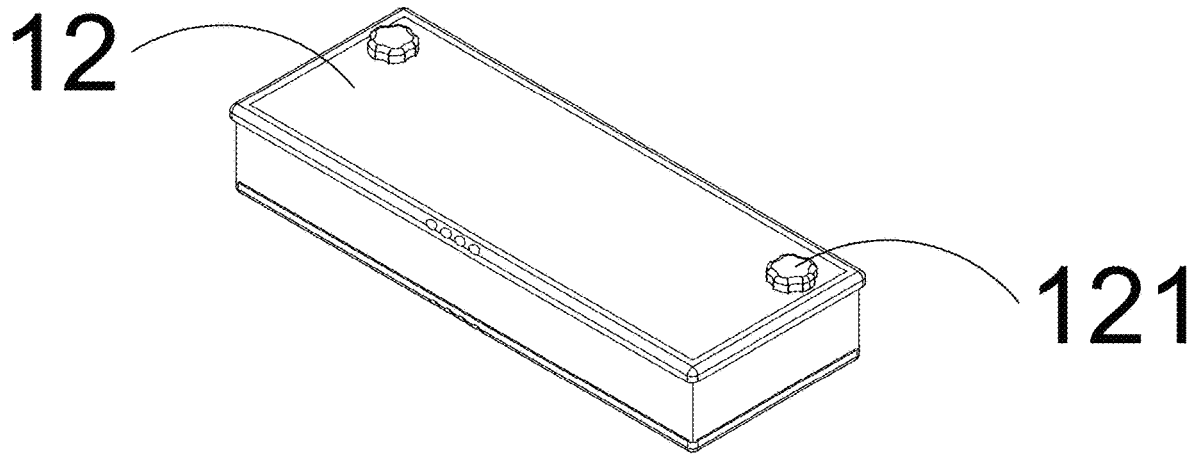
FIG. 4 is a schematic diagram of a water bag provided in Embodiment 1 of the present application after being filled with water.
Figure 5:
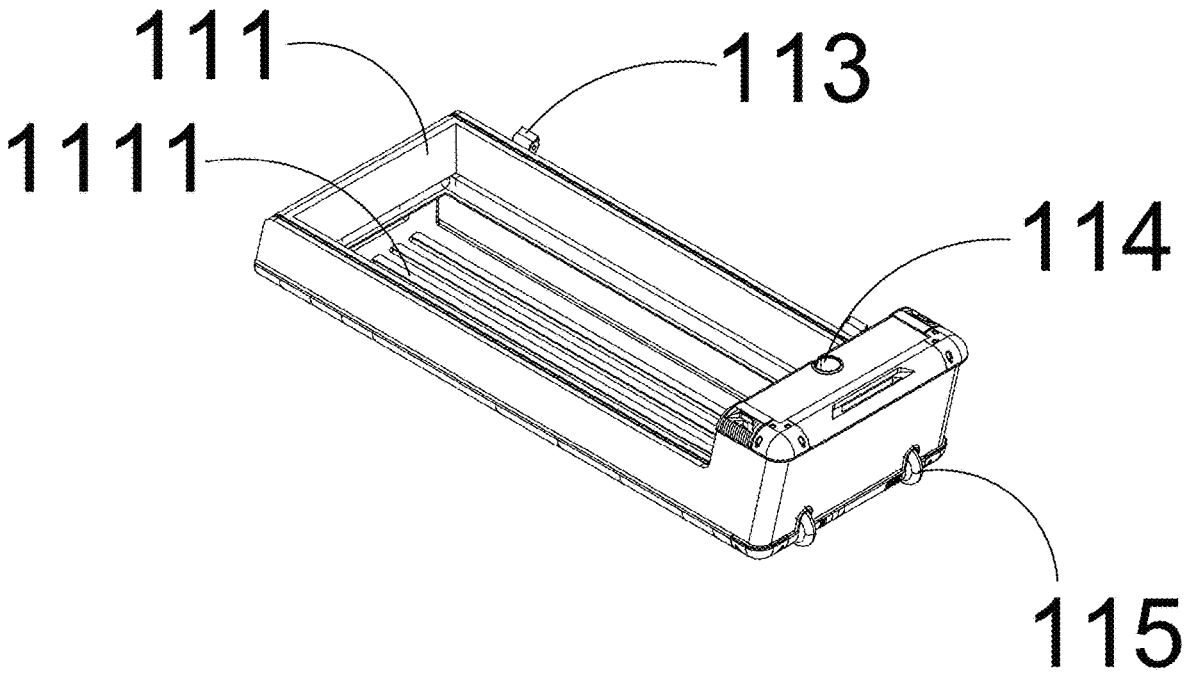
FIG. 5 is a first structural schematic diagram of a base body provided in Embodiment 1 of the present application.
Figure 6:
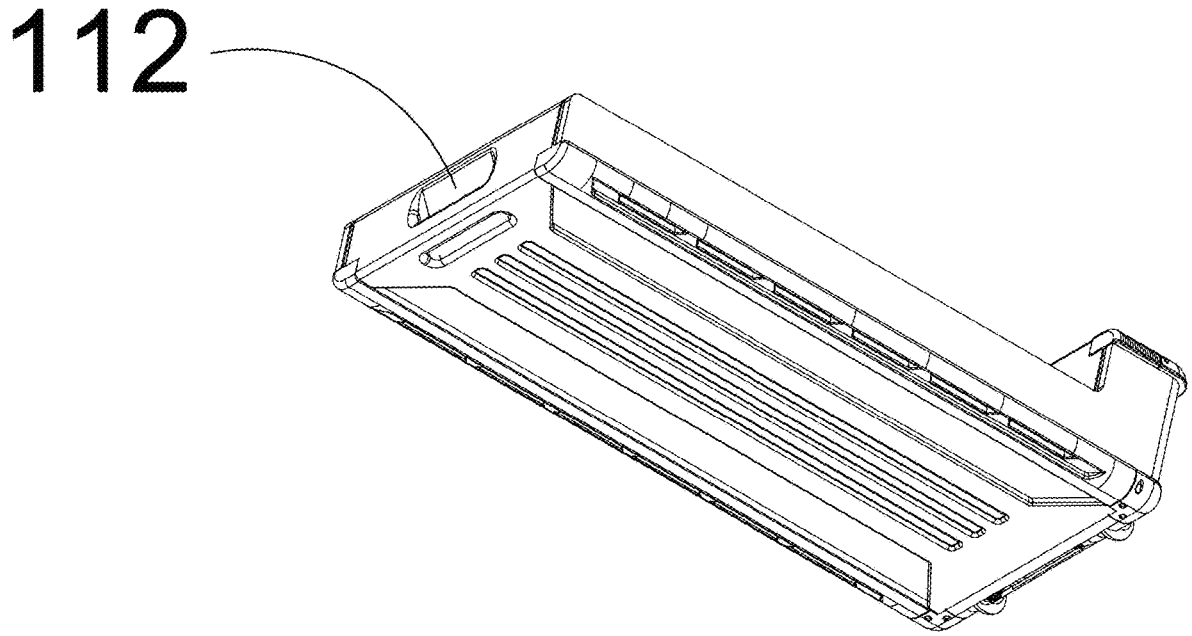
FIG. 6 is a second structural schematic diagram of the base body provided in Embodiment 1 of the present application.
Figure 7:
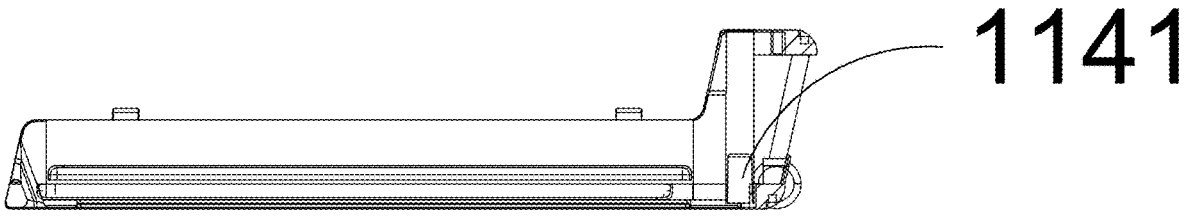
FIG. 7 is a cross-sectional schematic diagram of the base body provided in Embodiment 1 of the present application.

The following will describe the technical solution in the embodiments of the present application in combination with the drawings.

Embodiment 1

Please refer to FIGS. 1 to 7. The ball net stand device 10 has two states-deployment and folded. The folded state is used for transportation, and the deployment state is used for use.

The ball net stand device 10 includes two base bodies 11, a water bag 12, and a pin 13. There are two inlets and two outlets 121 on the water bag 12, and the two inlets and two outlet are positioned at the same centerline. For a convenience of differentiation, the base body 11 positioned below in the folded state is called base body A, and the base body 11 positioned above is called base body B.

The base body 11 is provided with an internal space 111, a handle 112, a rotation shaft 113, an upright rod hole 114, and a roller 115. A fix circular table 1141 is provided inside the upright rod hole 114, the upright rod hole 14 is connected to a support rod and the fix circular table 1141 assists in fixing the support rod. The roller 115 and handle 112 are both installed at a bottom of the base body 11, and the handle 112 is installed on other side relative to the roller 115, the roller 115 and the upright rod hole 114 are positioned at the same side. Two rollers 115 are provided, and both rollers 115 and handles 112 are used to facilitate a movement of the ball net stand device 10.

By a connection of the pin 13 with the rotation shaft 113, the base body A is rotationally connected to the base body B, so that the base body B can be folded and placed on the base body A, i.e., in the folded state. It is convenient to drag the ball net stand device 10. The pin 13 can be fixed on the rotation shaft 113 of the base body A or the base body B, or it can be used as an independent component to connect the rotation shaft 113 that fixes the base body A and the base body B. The advantage of fixing pin 13 on the rotation shaft 113 is that there is no need to store pin 13 separately, so there is no need to consider a disconnection between the base body A and the base body B caused by losing pin 13. The advantage of pin 13 as an independent component lies in strengthening a connection strength between the base body A and the base body B, and thereby improving its service life.

The internal space 111 stores the water bag 12 and can also store corresponding sports equipment, such as a ball net 15, a racket, a ball, a support rod, etc. If the water bag 12 leaks, discharged water will also accumulate in the internal space 111, which renders it easy to concentrate and discharge the water without polluting the stadium environment and requiring no time or effort to clean the stadium.

The internal space 111 is provided with a clamp strip 1111, which is used to fix the sports equipment, so that during a movement process, the sports equipment will not move with the movement of the ball net stand device 10.

Figure 8:
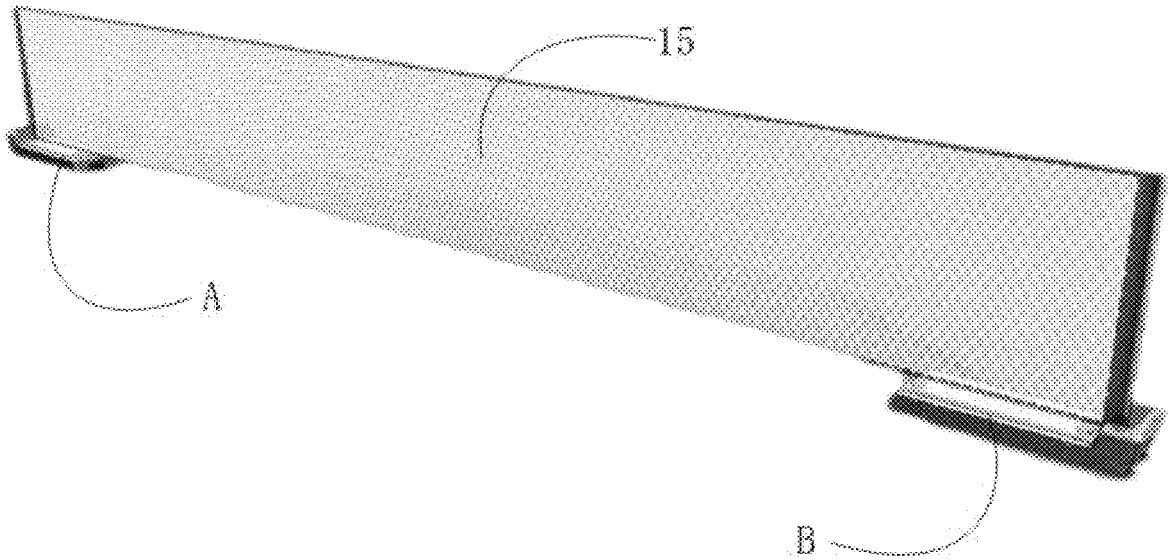
FIG. 8 is a schematic diagram of a use of the ball net stand device provided in Embodiment 1 of the present application.
Figure 9:
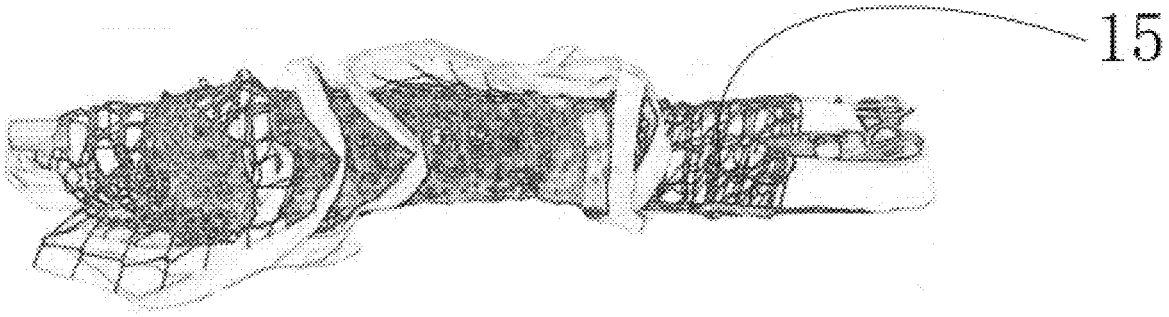
FIG. 9 is a schematic diagram of a ball net provided in Embodiment 1 of the present application.
Figure 10:
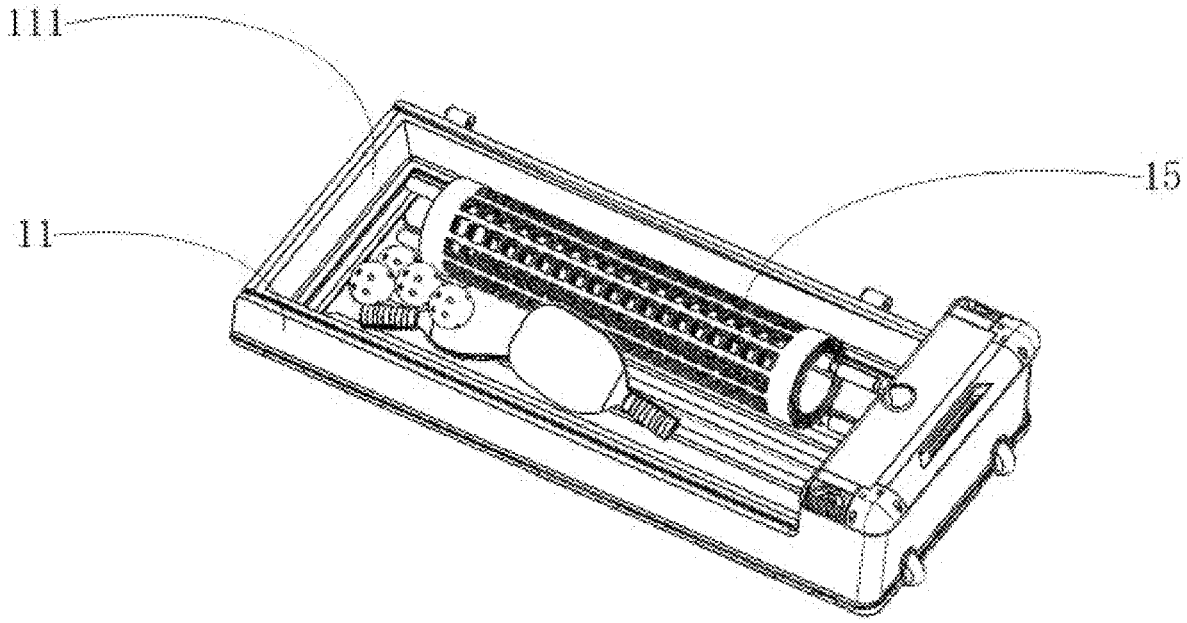
FIG. 10 is a schematic diagram of an internal space provided in Embodiment 1 of the present application for storing sports equipment.

Please refer to FIG. 8 to FIG. 10, a usage method of the ball net stand device 10. After entering a court, the pin 13 can be removed to separate the base body A from the base body B and place it in a suitable position. Take out the sports equipment stored in the internal space 111, insert the support rod into the upright rod hole 114, and cover it with the ball net 15. Fill the water bag 12 with an appropriate amount of water through two inlets and two outlets 121, put it back into the internal space 111. Then, engage in sports activities.

Embodiment 2

Figure 11:
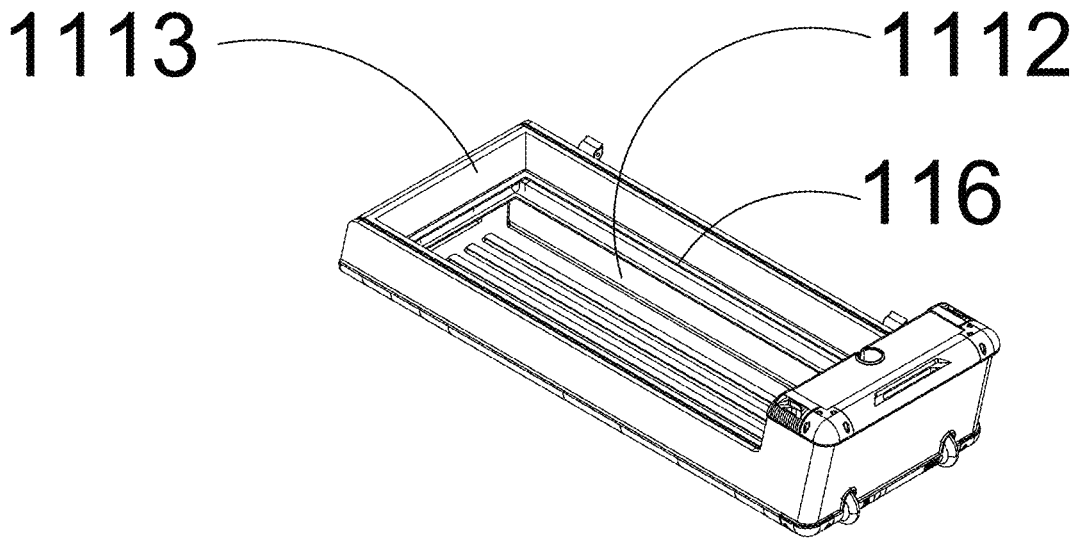
FIG. 11 is a structural schematic diagram of the base body provided in Embodiment 2 of the present application.

The main difference between Embodiment 2 and Embodiment 1 is step 116. Please refer to FIG. 11, the base body 11 is provided with a step 116. The step 116 is located within the internal space 111; thus, the internal space 111 is divided into a first space 1113 and a second space 1112. The first space 1113 is located above the step 116, and the second space 1112 is located below the step 116. The first space 1113 accommodates the water bag 12, and the step 116 supports and fixes the water bag 12. The second space 1112 accommodates the sports equipment. Thus, the water bag 12 and sports equipment are stored in their respective spaces. All other parts are the same.

Embodiment 3

Figure 12:
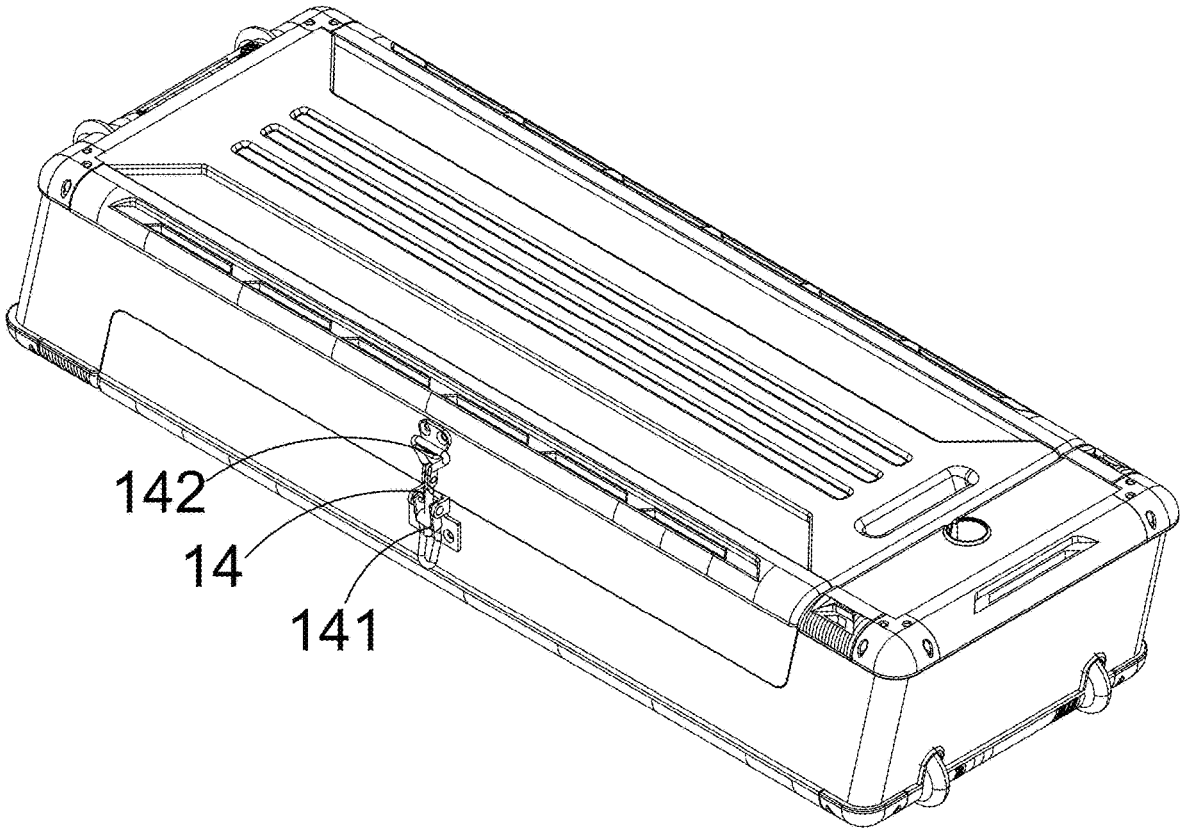
FIG. 12 is a structural schematic diagram of the ball net stand device provided in Embodiment 3 of the present application.

The main difference between Embodiment 3 and Embodiment 1 is buckle 14. Please refer to FIG. 12. The ball net stand device 10 includes a buckle 14, which includes a buckle body 141 and a hook piece 142. The buckle body 141 and the hook piece 142 are respectively installed on different base bodies 11, and their positions correspond to each other, so that the buckle body 141 can hook the hook piece 142. Thus, when the base body 11 rotates and is connected to another base body 11, the buckle 14 secures the two base bodies 11, ensures that they do not separate during movement, and further ensures a smooth movement. All other parts are the same.

In the embodiments of the present application, the ball net stand device 10 includes two base bodies 11, a water bag 12, and a pin 13. The two base bodies 11 are rotatably connected and separated to form two separate ball net bases. It can be carried anytime when being combined. The internal space 111 can accommodate sports equipment and water bag. Because it is relatively light, it is easy to carry when going out for play or venue transfer. The product can be dragged to a desired location through the handle 112, which is installed on the other side relative to the roller 115. There is a water bag inside each base body 11, which can hold water to increase its weight. After being filled with water, the weight can reach 15-20GK. By utilizing the principle of water bag weight increase, the base weight is increased to prevent issues such as displacement caused by an external force impact.

The above are only embodiments of the present application and are not intended to limit the protection scope of the present application. For those skilled in the art, the present application may undergo various modifications and changes. Any modifications, improvements, or equivalent substitutions made within the spirit and principles of the present application shall be included within the protection scope of the present application. It should be noted that similar references and letters represent similar terms in the following drawings, so once a term is defined in one drawing, further definition and explanation are not required in subsequent drawings.

What is claimed is:

1. A ball net stand device, comprising two base bodies, a water bag, and a pin;

wherein the two base bodies are rotatably connected through the pin; the base body has an internal space, and there is an upright rod hole and a rotation shaft on the base body; the internal space is used to accommodate the water bag.

2. The ball net stand device according to claim 1, wherein the base body is provided with a roller and a handle.

3. The ball net stand device according to claim 1, wherein the base body is provided with two rollers.

4. The ball net stand device according to claim 2, wherein the roller and the handle are both positioned at a bottom side of the base body, and the handle is positioned at another side of the roller.

5. The ball net stand device according to claim 2, wherein the roller and the upright rod hole are positioned at the same side.

6. The ball net stand device according to claim 1, wherein the water bag comprises an inlet and an outlet.

7. The ball net stand device according to claim 1, wherein the water bag comprises two inlets and two outlets.

8. The ball net stand device according to claim 6, wherein the inlet and the outlet are positioned above the water bag and positioned at the same centerline.

9. The ball net stand device according to claim 1, wherein the internal space is used to accommodate sports equipment.

10. The ball net stand device according to claim 9, wherein the internal space is provided with a clamp strip, and the clamp strip is used to fix the sports equipment.

11. The ball net stand device according to claim 10, wherein the internal space is provided with a step, which is used to separate the internal space and support the water bag.

12. The ball net stand device according to claim 1, wherein the upright rod hole is provided with a fix circular table; the fix circular table is used to assist in fixing a ball net rod.

13. The ball net stand device according to claim 1, further comprising a buckle, wherein the buckle comprises a buckle body and a hook piece; the buckle body and the hook piece are respectively installed on different base bodies, and their positions correspond to each other.

14. The ball net stand device according to claim 7, wherein the inlets and the outlets are positioned above the water bag and positioned at the same centerline.

* * * * *